United States Patent [19]

Lampson

[11] 4,349,115

[45] Sep. 14, 1982

[54] CRANE

[75] Inventor: Neil F. Lampson, Kennewick, Wash.

[73] Assignee: Riggers Manufacturing Co., Kennewick, Wash.

[21] Appl. No.: 139,798

[22] Filed: Apr. 14, 1980

[51] Int. Cl.[3] ..... B66C 23/08

[52] U.S. Cl. ..... 212/178; 212/198

[58] Field of Search ..... 212/156, 178, 196, 197, 212/198, 179, 180, 195

[56] References Cited

U.S. PATENT DOCUMENTS

| | | | |
|---|---|---|---|
| 3,202,299 | 8/1965 | DeCuir | 212/195 |
| 3,209,920 | 10/1965 | DeCuir | 212/195 |
| 3,485,383 | 12/1969 | Beduhn | 212/195 |
| 3,777,900 | 12/1973 | Brewer | 212/197 |
| 3,836,010 | 9/1974 | Lampson | 212/178 |
| 3,842,984 | 10/1974 | Brown et al. | 212/195 |
| 4,170,309 | 10/1979 | Lampson | 212/198 |
| 4,258,852 | 3/1981 | Juergens | 212/178 |

FOREIGN PATENT DOCUMENTS

| | | | |
|---|---|---|---|
| 1246969 | 8/1967 | Fed. Rep. of Germany . | |
| 6405689 | of 0000 | Netherlands . | |
| 1432464 | 4/1976 | United Kingdom | 212/178 |
| 203877 | 12/1967 | U.S.S.R. . | |

OTHER PUBLICATIONS

"Lampson Transi-Lift".

Lampson Transi-Lift 1002 Ton Lift Published Jul. 1979.

*Primary Examiner*—Joseph F. Peters, Jr.

*Assistant Examiner*—Michael Mar

*Attorney, Agent, or Firm*—Wells, St. John & Roberts

[57] ABSTRACT

A counterbalanced crane structure having an upright boom and diverging staymast mounted to a ground supported mobile crane base. An independent mobile counterweight unit has a vertical counterweight strut connected to the outer end of the staymast. The counterweight unit is interconnected with the crane base by an elongated horizontal stinger assembly. The counterweight unit is powered to move in an arc, the center of which is determined by the crane base. Turning motion is transmitted from the moving counterweight unit to the main boom and staymast by the stinger. Movable connections on the stinger permit pivotal movement of the counterweight unit about an axis that is substantially radial with the center turning axis of the mainboom and staymast and another pivot axis that is transverse to the radial axis. Limited movement of the counterweight unit toward or away from the crane base is permitted to eliminate direct transfer of tension and compressive stresses through the stinger. The counterweight strut directly transmits tension and compressive forces between the outer end of the staymast and the ground supported counterweight unit. It operates as a mast stop, supporting the staymast against sudden recoil when a sudden shifting of a load occurs along the main boom. Additionally, the counterweight strut facilitates erection of the crane assembly.

8 Claims, 5 Drawing Figures

CRANE

BACKGROUND OF THE INVENTION

The present invention relates generally to cranes and more particularly to cranes having a powered counterbalance unit spaced a substantial distance from an independently supported boom structure.

Rearwardly spaced counterweight structures provide stability to a loaded boom by counterbalancing the tendency of a load to produce a tipping moment. In general, the rearward displacement of the counterweight is a critical factor in the determination of the limits of control and lifting capacity of a crane.

One such form of crane structure includes a self-pivoting boom mounted on a vehicle that is provided with an immovable extended trailer. This trailer supports a traveling counterweight that can be displaced outward on the trailer as the lifted load increases either due to load size or displacement of the load from the base of the boom. The operator is limited to a relatively small arc through which he may move a load, the length of arc on each side of the boom center being decreased as the size of the load is increased. Sometimes outriggers are used to broaden the base of a vehicular crane. Outriggers, however, tend to eliminate any possibility of mobility under load.

U.S. Pat. No. 3,836,010, granted to the present applicant, marked a substantial improvement in the heavy lift crane field. It disclosed a mobile crane structure with a horizontally rotatable load platform. The platform was rigidly connected to a rearwardly displaced counterweight unit. The distance between the two mobile base units was spanned by a rigid spreader link or stinger used to transmit motion of the mobile counterweight unit to rotational motion of the boom and staymast mounted on the load platform. Thus, a crane structure was provided that included a rotatable platform supporting a boom and staymast with great load lifting capacity and which was stabilized by a counterbalanced, earthborn mobile vehicular base that precisely and accurately moved the boom and staymast about a vertical axis defined at their supporting platform.

The present improvements were added to the patented structure to increase its over-all stability and efficiency of operation. For example, longitudinal forces applied along the length of the "spreader link" or stinger mounted between the pivoted load platform and the counterweight unit can be substantial unless the powered mobile unit is moved in a perfect circular arc about the center pivot axis of the platform. Furthermore, severe bending and torsional stresses can be applied if the counterweight unit shifts elevationally or moves over slightly rough terrain. It therefore becomes desirable to provide some form of interconnecting mechanism that will allow limited radial movement of the counterweight unit relative to the crane base and which accommodates slight elevational movement of the counterweight unit relative to the crane base. Allowances for such movement must be made without detracting from the ability of the counterweight unit to transmit turning forces directly to the main boom and staymast assembly for the purpose of pivoting the boom and load.

Another common problem is the tendency of an unloaded boom to recoil in a backward direction due to the moments applied to it by the overhead support rigging. It is common practice to use safety stops or cables between interconnected boom or mast members to limit the upward angle of the boom. The straps effectively prevent the boom from being pulled too high when unloaded but also limit the minimum radius at which loads can be lifted. Furthermore, such straps are not entirely effective when used in conjunction with single unit boom arrangements where the boom is supported directly at the crane base. In such cases, the boom is of substantial length and mounting of a safety strap or cable between the boom and base would be difficult, if not impossible, due to geometric restrictions between the boom and base.

When spacing between the boom base and counterweight unit is substantial to gain mechanical advantage at the end of the boom, a staymast is employed that extends rearwardly opposite the boom. The potential moment exerted on the raised, unloaded boom by the combined weight of the staymast and rigging often require safety stops or cables beyond practical strength limitations. One particularly serious problem can occur with structures using a backwardly angled staymast. If a heavy load is suddenly dropped or detached from the main boom, a backlash or recoil effect is produced causing a tendency for the boom to pivot upwardly toward the upright base pivot axis. This energy is often taken up before the boom reaches the upright orientation or passes over center due to the fact that the boom has a positive downward impetus opposite the direction of the recoil forces. The staymast, on the other hand, is subjected to a downward moment that is in the direction of the recoil. Thus, forces produced during recoil on the staymast are substantially greater. Limiting stops extending between the base of the staymast and spreader link or counterweight unit are impractical due to the potentially tremendous forces applied through the staymast. It is therefore desirable to provide some form of brace arrangement that will effectively support the outer end of the staymast in a stable condition regardless of loading, and that will not adversely affect performance characteristics of the crane.

The present crane structure includes mechanisms for accommodating limited relative movement between the crane base and counterweight unit, in addition to providing a counterweight strut extending between the counterweight unit and the outer end of the staymast. A telescoping, pivoted connection is provided between the mobile crane base and counterweight unit that permits both radial movement of the counterweight unit relative to the crane base and relative pivotal movement between them without undesirable loading at the connections along the length of their connecting stinger. A rigid counterweight strut extends between the staymast and the remote counterweight unit to replace the usual backstay lines or stops. It serves as a tension and compression member when the load is being applied or removed from the boom. It further functions to assist in the physical erection of the crane structure.

DETAILED DESCRIPTION OF A PREFERRED EMBODIMENT

Figure 1:
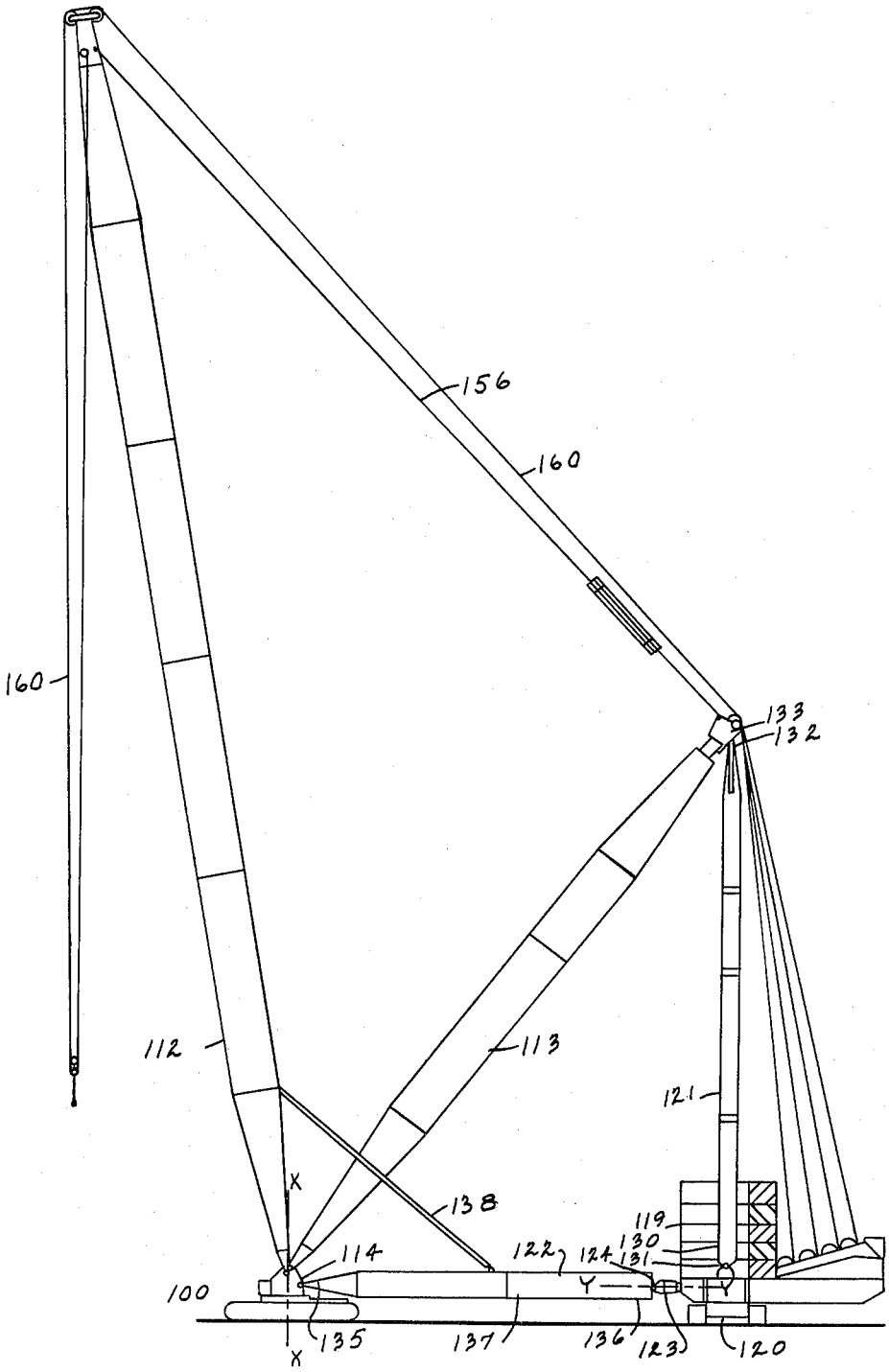
FIG. 1 is an elevational diagrammatical view of the crane structure.

The embodiment of the invention shown in the accompanying drawings includes a crane base in the form of a transporter 100 supporting an elongated main boom 112 and a rearwardly diverging staymast 113 from a central platform 114. The main boom 112 is mounted at a horiozontal pivot 115 to the platform 114. Staymast 113 may be pivotably mounted to platform 114 on a coaxial pivot arrangement. The platform 114 rotates on the transporter 100 about an upright boom axis X—X (FIG. 1) as the center of the turning radius for the boom and staymast.

A mobile counterweight unit in the form of a second transporter 120 is spaced outward from the platform 100. Transporter 120, in addition to supporting a heavy counterweight 119, also carries a vertical counterweight strut 121. The strut 121 vertically supports the outer end of staymast 113 above the platform 120.

An elongated spreader link or "stinger" 122 extends horizontally between the transporters 100 and 120. The stinger 122 defines a radius about which the counterweight base 120 can move about axis X—X. Pivotal motion of boom 112 is provided by turning forces from the driving transporter 120 to the platform 114 on the stationary transporter 100.

The lower end 130 of counterweight strut 121 is pivotally mounted to the counterweight base 120 about a horizontal axis at pivot connection 131. This axis is parallel to the ground surface and substantially perpendicular to the longitudinal orientation of stinger 122. The pivot connection 131 is physically loose to allow for slight relative motion between strut 121, transporter 120, and staymast 113. This prevents transmission of otherwise damaging torsion forces to the transporter or staymast.

The upper end 132 of the strut 121 is pivotably connected at 133 to the outer end of staymast 113. The end 132 is situated directly above the bottom end 130. Forces applied at the end of the staymast will produce simple tension and compressive loads along the length of the strut. The end 132 is also provided with sheaves that guide cable over the junction of the strut and staymast to the boom. These sheaves and cables are also used during erection of the crane assembly.

The stinger 122 includes an inward end 135 that is mounted to the platform 114 of transporter 100. An opposite end 136 is mounted by a telescoping connector means 123 and pivot means 124 to the counterweight transporter 120. A rigid frame 137 preferably extends between these ends to transmit turning forces from counterweight transporter directly to platform 114.

A snubber 138 is positioned angularly between the stinger assembly and boom 112 to react against the boom during backlash or recoil situations in which the boom would otherwise pivot over-center and fall toward the staymast. The snubber 138 is of standard construction.

Figure 2:
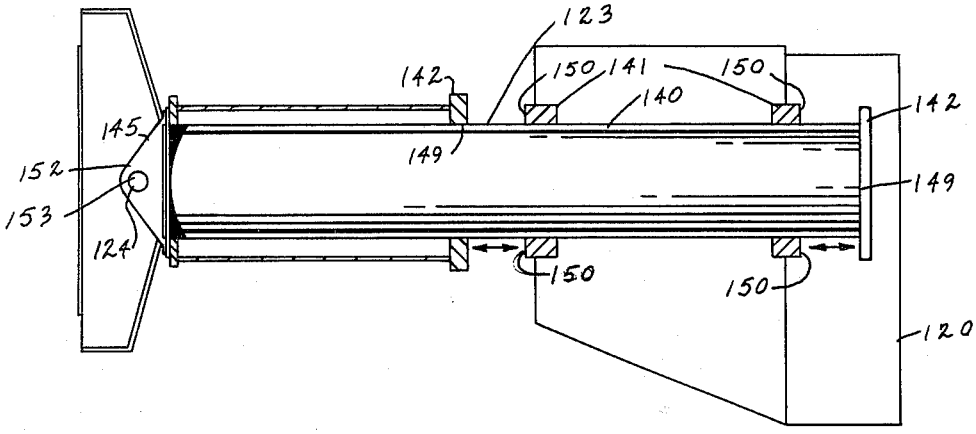
FIG. 2 is an enlarged fragmentary view of the pivot and telescoping arrangement by which the counterweight unit is mounted to the stinger.

The telescoping connector means 123 is shown in substantial detail in FIG. 2. It includes a first tubular member 140 slidably received within a second tubular member 141. Members 140 and 141 operably interconnect the counterweight transporter 120 and transporter 100 with the stinger 122 to permit pivotal movement of one transporter relative to the other about an axis Y—Y that is horizontal and parallel with the stinger 122. The members 140 and 141 are free to pivot relative to one another about this axis and therefore permit relative pivotal movement of the transporters 100 and 120 relative to each other.

The tubular members 140 and 141 are capable of limited axial sliding movement relative to each other. This permits relative movement of the transporters 100 and 120 toward and away from one another. This motion is limited by stop means 142 provided on the surfaces of members 140 and 141. Specifically, the stop means include raised shoulders provided on the first tubular member for engaging similar surfaces on the second member 141. The shoulders of the first tubular member 140 are spaced apart substantially wider than the surfaces on the outer tubular member. The difference in spacing between the shoulders and surfaces determines the amount of free travel allowed between the two bases. In a typical application, this distance may be in the vicinity of one foot, which is adequate to accommodate the capability of operators to coordinate movement between the two powered transporters. With this arrangement, slight relative movement of the counterweight transporter 120 toward or away from the transporter 100 will not result in the application of excessive tension or compression forces through the stinger. The tubular members 140 and 141 will simply slide along the axis Y—Y while continuing to transmit horizontal turning forces lateral to the axis Y—Y.

It is preferable, but not necessary, that the first tubular member 140 have an end 145 that is mounted to the stinger. The length of the member 140 then passes through the second tubular member 141 toward the counterweight transporter 120. The second tubular member 141 is fixed to the counterweight transporter 120.

The stop means 142 preferably includes raised shoulders 149 situated on the tubular member 140. These shoulders will come into abutment with the surfaces 150 on the second tubular member at opposite ends of the limits of travel defined by shoulders 149.

The tube end 145 is preferably mounted to the stinger 122 by pivot means 124. Means 124 can be provided in the form of a bracket 152 at the stinger end and a pivot pin 153 interconnecting the bracket 152 with the tubular member 140. The pin 153 will define a transverse horizontal pivotal axis that will allow relative pivotal motion of the two transporters about that axis should one side or the other of the counterweight transporter 120 become elevated or lowered relative to the transporter 100. The pivot also is useful when both units are moving from one site to another. Pivotal movement between the two transporters can thus be accommodated either by the pivot means 124, telescoping connector means 123, or at the pivot connection between the stinger and platform 114.

Figure 3:
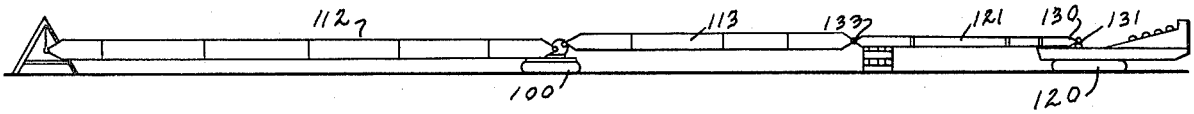
FIGS. 3 through 5 are views showing the sequences of steps taken to erect the crane structure.
Figure 4:
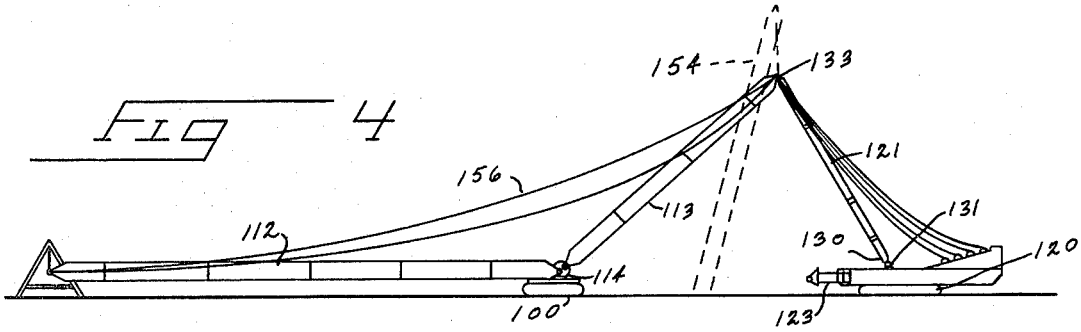
Figure 5:
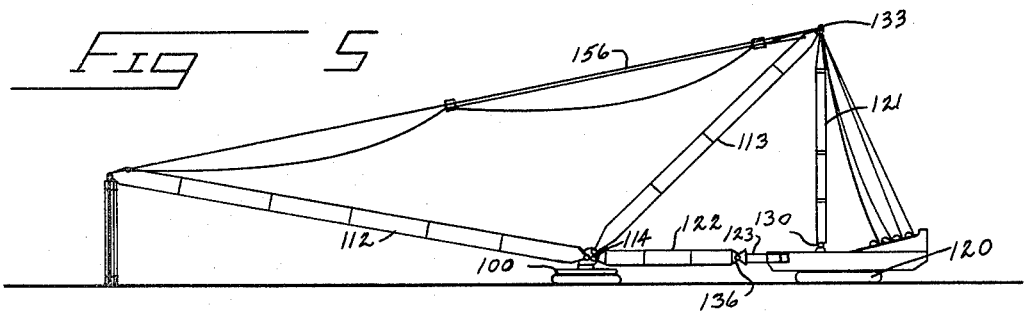

The sequence involved in the basic erection of the crane structure is shown in FIGS. 3 through 5. FIG. 3 illustrates the initial assembly at the site, wherein the transporter 100 and counterweight transporter 120 have their respective tracks in alignment. The main boom 112, staymast 113, and counterweight strut 121 are aligned and substantially horizontal. The remote end of the main boom is suspended slightly above the ground surface by a cable to avoid undesirable lateral stresses that could otherwise be applied during erection of the staymast and strut. This may be done using a crane (not shown) or any appropriate cable hoisting mechanism. An auxiliary "picker" crane 154 is used to pick the staymast 113 and strut 121 at their connection point 133.

Crane 154 is used to elevate the staymast and strut ends substantially to the position illustrated in FIG. 4. During this time, the transporter 100 is stationary and counterweight transporter 120 is moved toward it. Counterweight transporter 120 is not used to push against the strut or staymast to assist the erection, but follows their movement as the staymast and strut ends are lifted.

After the staymast 113 and strut 121 attain the position shown in FIG. 4, the boom hoist and cables 156 can be used, along with the cantilevered weight of the main boom 112 to pull them upwardly to their final positions shown in FIG. 1. Transporter 120 is powered again to follow this continuing erection sequence by moving toward transporter 100. If, for some reason, the staymast should bind and not swing further upwardly, the cables 156 will become taut and the boom 112 will begin to rise. The situation will be obvious to those erecting the assembly, who can immediately take corrective steps before any structural elements are damaged.

When the staymast 113 and strut 121 have almost reached their operative positions, the stinger 122 is moved between the transporter and its ends 130 is mounted to the platform 114. The remaining end 136 will eventually be engaged by the bracket 152 of pivot means 124. The pin 153 is then inserted and the crane assembly is then ready for use.

During operation, the boom 112 is hoisted to a desired angle and a load placed on the boom load cables 160. Tension applied along the cables 160 produces a lifting force at the end of staymast 113. This force is transmitted directly to the counterweight transporter 120 through the rigid strut 121. Conversely, when a load is released suddenly from the cables 160, a recoil effect takes place. This can cause the boom 112 to jump slightly upward and the staymast 113 will react downwardly against the upright strut 121. The resulting compressive forces along the vertical rigid strut 121 are transmitted directly to the counterweight transporter 120 without damaging either the strut or staymast.

When the counterweight transporter 120 is driven to rotate the boom 112 about axis X—X, slight variations in its radial separation from the axis X—X is accommodated by the telescoping tubular members 140 and 141. Furthermore, relative pivotal movement about axis Y—Y, the axis of pivot pin 153 and about the pivot connection between stinger 135 and platform 114 allow for relative angular deflection between the two transporters. Therefore, only pure turning moments are applied from transporter 120 to platform 144 about the axis X—X through the stinger 122.

The above description and attached drawings are provided as an example of the present invention.

What I claim is:

1. A counterbalanced crane structure, comprising:

a ground supported crane base;

a main boom;

a platform mounting the main boom to the crane base;

a mobile counterweight unit remote from the platform;

rigging means operably connected between the counterweight unit and the main boom for positioning the main boom in an upright orientation;

an elongated stinger frame; and means at opposed ends of the stinger frame adapted to mount the stinger frame to the crane base and counterweight unit, respectively;

telescoping connector means along the stinger frame for permitting the counterweight unit to freely move a limited distance toward and away from the crane base parallel to the stinger frame and for permitting relative pivotal movement of the counterweight unit relative to the crane base about a longitudinal axis parallel to the stinger frame.

2. The stinger assembly as defined by claim 1 wherein the telescoping connector means is comprised of two slidably interfitted tubular members, rotatable to each other about said longitudinal axis, and wherein one member is adapted for mounting to the counterweight unit and the other tubular member is mounted to the crane base and to the stinger frame.

3. The stinger assembly as defined by claim 2 further comprising pivot means mounting said other tubular member to the stinger frame for pivotal movement about a horizontal axis that is transverse to said longitudinal axis.

4. The stinger assembly as defined by claim 3 further comprising stop means on the tubular members for limiting movement along said longitudinal axis of one tubular member over the other.

5. The stinger assembly as defined by claim 4 wherein the stop means is comprised of longitudinally spaced abutment shoulders on one of the tubular members aligned with similar longitudinally spaced abutment surfaces on the other member, the abutment surfaces on the one member being spaced apart longitudinally by a distance greater than the distance separating the abutment surfaces of the other member.

6. A counterbalanced crane structure, comprising:

a ground supported crane base;

a main boom;

a platform mounting the main boom to the crane base;

a mobile counterweight unit remote from the platform;

rigging means operably connected between the counterweight unit and the main boom for positioning the main boom in an upright orientation;

a rigid stinger operably connecting the platform and the mobile counterweight unit;

pivot means along the stinger for allowing relative pivotal movement between the counterweight unit and platform about a horizontal axis transverse to the stinger; and telescoping connector means mounted on the stinger for permitting limited movement of the counterweight unit and platform relative to one another along the stinger and for permitting pivotal movement of the counterweight unit and platform relative to one another about an axis parallel to the stinger;

said telescoping connector means comprising:

a first member having a longitudinal axis parallel to the stinger;

a second member movably mounted to the first member for axial sliding motion between them along said longitudinal axis and for pivotal movement between them about said longitudinal axis;

stop means along the first and second members for limiting axial sliding motion of one relative to the other; and one of the members being axially fixed relative to the platform and the remaining member being radially fixed relative to the counterweight unit.

7. The crane structure as defined by claim 6 wherein the first member is mounted to the stinger and the second member is on the counterweight unit.

8. The crane structure as defined by claim 7 wherein the stop means is comprised of a pair of raised shoulders on the first member arranged thereon on opposite sides of the second member to abut ends thereof at selected limits of relative axial movement between the crane base and counterweight unit.

* * * * *